US006364200B1

(12) United States Patent
Moss et al.

(10) Patent No.: US 6,364,200 B1
(45) Date of Patent: Apr. 2, 2002

(54) BULK BOX WITH QUICK-LOCK BOTTOM AND SET-UP FEATURE

(75) Inventors: William F. Moss, Canonsburg, PA (US); Brian K. Jambois, Mechanicsville, VA (US); John Evans, Herminie; Stephen R. Byrski, Bethel Park, both of PA (US); John R. Boutin, Youngsville, LA (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/635,740

(22) Filed: Aug. 11, 2000

(51) Int. Cl.[7] ..... B65D 5/10

(52) U.S. Cl. ..... 229/109; 229/128; 229/156; 229/157; 229/185

(58) Field of Search ..... 229/109, 126, 229/128, 156, 157, 183, 185

(56) References Cited

U.S. PATENT DOCUMENTS 1,546,601 A * 7/1925 Morris ..... 229/156
2,105,243 A * 1/1938 Gruber et al. ..... 229/183
2,384,559 A * 9/1945 Powell ..... 229/117
2,702,154 A * 2/1955 Linson ..... 229/117
4,194,679 A * 3/1980 Lohrbach et al. ..... 229/185
5,390,790 A * 2/1995 Straub et al. ..... 229/109
5,573,175 A * 11/1996 Straub et al. ..... 229/109

* cited by examiner

*Primary Examiner*—Gary E. Elkins
(74) *Attorney, Agent, or Firm*—Dennis H. Lambert

(57) ABSTRACT

A corrugated paperboard bulk box has opposed pairs of parallel side walls, and in a preferred embodiment, has interposed diagonal corner panels to form an octagonal box. The bottom of the box is closed by opposed pairs of interlocking major and minor bottom flaps, wherein one pair of flaps have notches in their free edges and the other pair of flaps have T-shaped locking tabs in their free edges. The notches form a central opening in the bottom when the flaps are folded closed, and the locking tabs are pushed through the opening to lock the flaps closed. Aligning tabs project outwardly from opposite side edges of one pair of opposed bottom flaps, and complemental slots are formed at the folding connection of another pair of bottom flaps, so that when the flaps are folded inwardly toward one another, the tabs extend into the slots to square the box and hold it square.

13 Claims, 7 Drawing Sheets

FIG.3
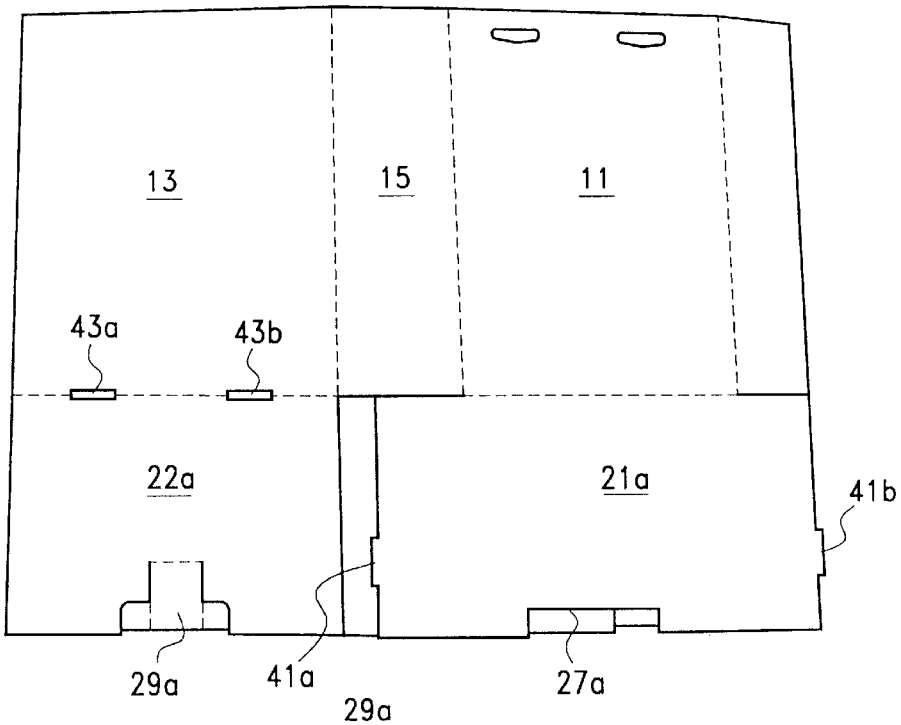
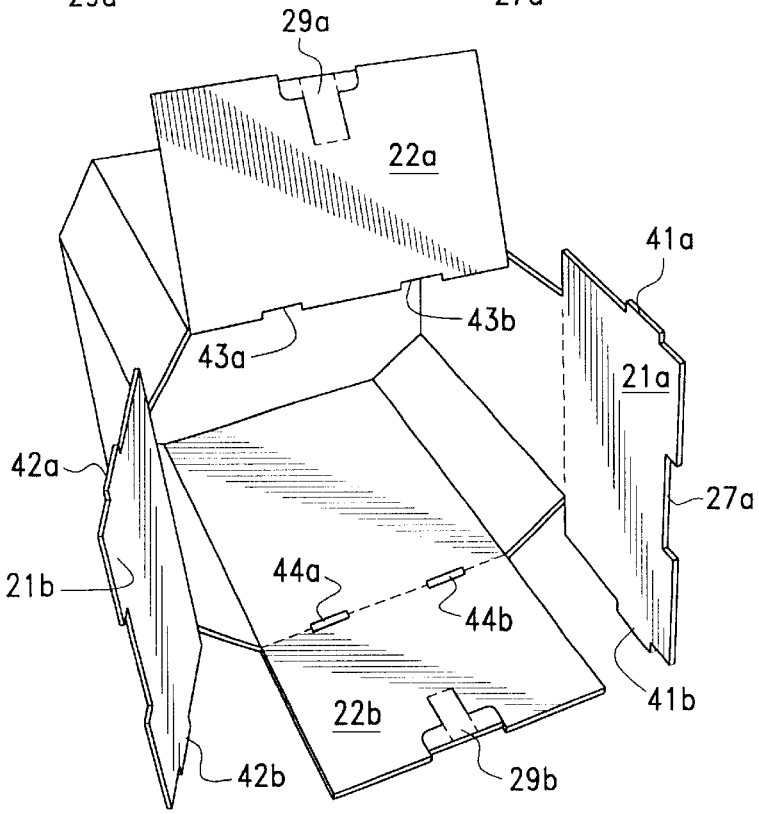
FIG.4

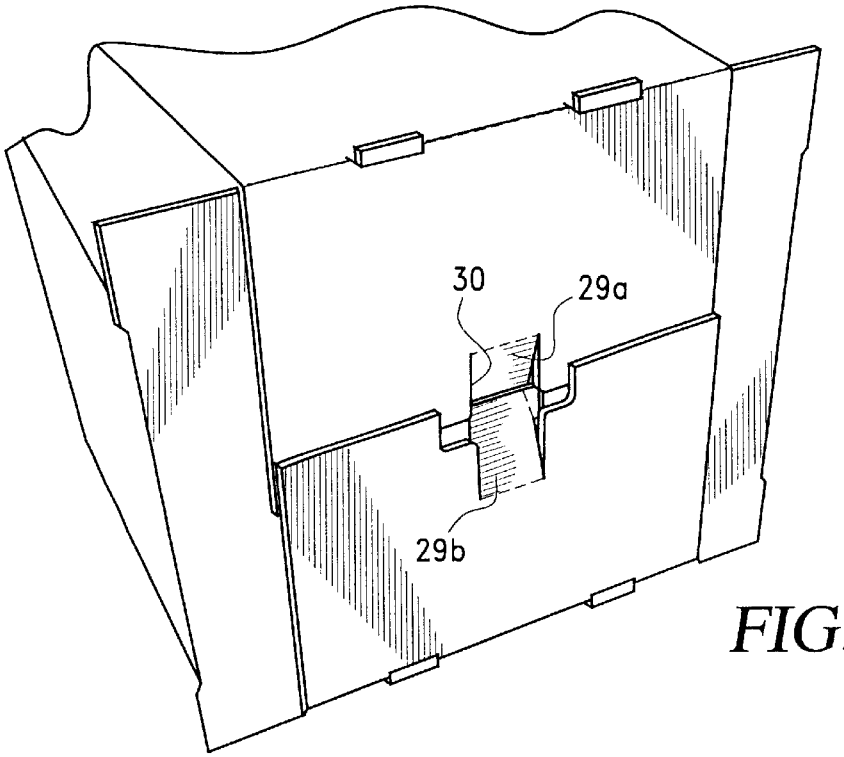
FIG. 11
FIG. 12
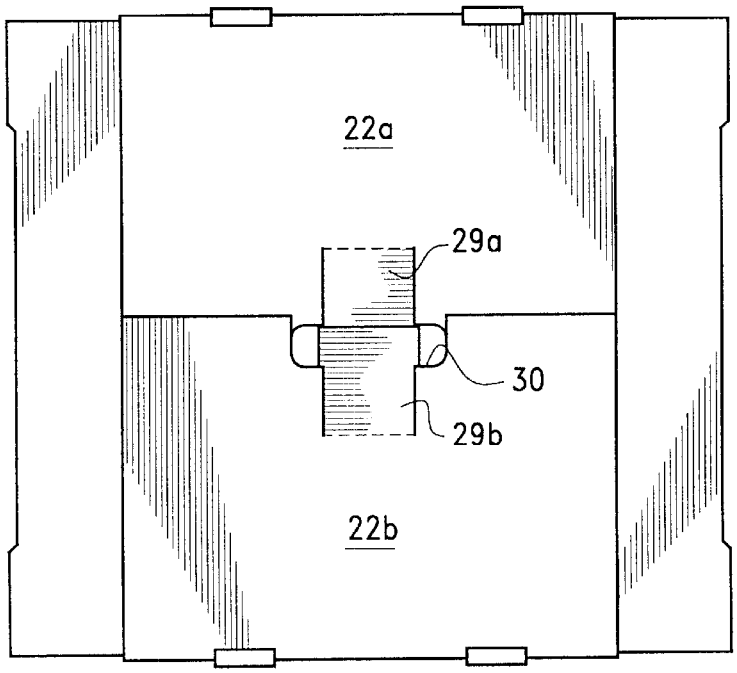

BULK BOX WITH QUICK-LOCK BOTTOM AND SET-UP FEATURE

BACKGROUND OF THE INVENTION

1. Field of the Invention

This invention relates to containers for the bulk storage and shipment of materials. More particularly, the invention relates to a corrugated paperboard bulk box with set-up assisting features and a locking bottom flap construction.

2. Prior Art

In the bulk handling of materials, e.g., fruit juices, tomato paste, meat, fresh produce, etc., containers of relatively large size are commonly used to transport and store the material. These containers must be capable of withstanding the weight of the contents, as well as the rough handling to which they may be subjected. Further, they should be relatively easy to set up, and capable of being stacked on top of one another, and of being handled with mechanized equipment.

A variety of containers have been developed in the prior art to meet these criteria, including metal drums, plywood bins and corrugated paperboard boxes. While metal drums and plywood bins possess the requisite strength and durability, they are expensive to manufacture, store and ship. Corrugated paperboard boxes are less costly to make, and generally can be collapsed for compact storage and shipment. However, they may be difficult to set up, and/or may not be capable of withstanding rough handling.

Accordingly, there is a need for a bulk container which is inexpensive to make and use, is strong and durable, may be collapsed for compact storage and shipment, and which is easy to set up.

SUMMARY OF THE INVENTION

The present invention comprises a bulk container which is strong and durable, which may be collapsed for compact storage and shipment, and which may be set up quickly and easily.

The container of the invention preferably is made of corrugated paperboard having adequate strength to withstand the weight of the contents and to enable multiple containers to be stacked on top of one another. It is also capable of being palletized so that it can be efficiently handled with mechanized equipment. The container can be collapsed for compact storage, and has a locking bottom flap construction that is quick and easy to set up and is durable even when subjected to rough handling. In particular, the container of the invention has aligning means which facilitates positioning and squaring up of the container during set up, and which holds it in that position after it is set up.

In a preferred embodiment, the container of the invention is an octagonal corrugated paperboard box having opposed pairs of parallel side walls and diagonal corner panels. Opposed pairs of major and minor bottom flaps are foldably joined along score lines at one edge to respective pairs of opposed side walls, and have opposite free edges. The locking bottom flap construction includes a notch or cut-out in the free edge of each of the major flaps, and a T-shaped central locking tab in the free edge of each of the minor flaps. When the flaps are folded inwardly toward one another to close the bottom of the box, the T-shaped locking tabs may be pushed through the opening formed by the notches in the minor flaps to lock the flaps in their inwardly folded position.

The major flaps include side portions extending in alignment with and cut from the bottom ends of the associated diagonal corner panels, so that when the major flaps are folded inwardly over the bottom of the box, the corners of the side portions project beyond the diagonal corner panels to define fastening tabs that may be used to secure the box to a pallet.

The aligning means includes a pair of spaced apart slots at the score line joining each minor bottom flap to its associated side wall, and a small tab projecting outwardly from the side edge of each of the side portions of the major bottom flaps. The tabs project into the slots to position and square-up the box and hold it in this position as the box is being set up and after the box is set up. More specifically, during set up of the box the minor flaps, or at least one of them, are in generally coplanar relationship with its associated side wall, and the major flaps, or at least one of them, are then folded inwardly over the bottom of the box, sweeping the tab along the surface of an adjacent minor flap until the tab comes into registry with the slot, whereupon the tab projects into the slot to hold the major flap in this folded position. After both major flaps are thus folded, the minor flaps are folded inwardly over the major flaps, and the locking tabs engaged. The location of the tabs and slots is such that when they are interengaged the box is properly aligned and squared.

When the major flaps and then the minor flaps are folded inwardly over the bottom of the box into overlying relationship with one another, it is necessary only to press inwardly on the T-shaped locking tabs to cause them to flex and move through the opening formed by the notches in the edges of the minor bottom flaps, whereupon the arms of the "T" expand or spring outwardly to engage behind the bottom flaps to lock the tabs, and thus the bottom flaps, in closed position. The bottom flaps are thereby securely interlocked with one another to form a strong closed bottom that remains in its erected condition even when the box is roughly handled.

Means may also be provided in the sidewalls for locking cooperation with a closure cap to be fitted over the top end of the box. In one embodiment, this means comprises a plurality of openings formed through at least a pair of opposed side walls near the top end thereof.

Although the preferred embodiment is an octagonal or eight-sided box, it should be understood that the invention may be adapted to other polygonal shapes, such as a four-sided or ten-sided box, for example. Further, the box of the invention may comprise any suitable flute construction, including AA, CA, BC, etc., depending upon the desired properties. Moreover, a moisture resistant adhesive may be used in the manufacture of the box, which may additionally be treated with a suitable commercially available moisture resistant material. Further, if desired, a liner may be placed inside the box. The liner and the box may each comprise one-piece triple wall constructions laminated together.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 3 is a top plan view of the box of the invention lying on its side in a folded flat condition;

FIG. 4 is a bottom perspective view of a partially erected box according to the invention, shown with its bottom side nearest, and the major and minor bottom flaps in outwardly splayed positions, with the minor flaps oriented at the top and bottom and the major flaps oriented at opposite sides, respectively;

FIG. 11 is a bottom perspective view similar to FIG. 10, but showing both locking tabs in fully locked position;

FIG. 12 is an outside bottom plan view of the fully erected box of the invention.

DETAILED DESCRIPTION OF THE PREFERRED EMBODIMENTS

Referring more specifically to the drawings, an octagonal corrugated bulk box according to the invention is indicated generally at 10. The box includes pairs of opposed parallel side walls 11, 12 and 13, 14, and diagonal corner panels 15, 16, 17 and 18. Although not shown, a lid or cover may be placed on the open upper end of the container, and the box may be mounted on a pallet.

Figure 6:
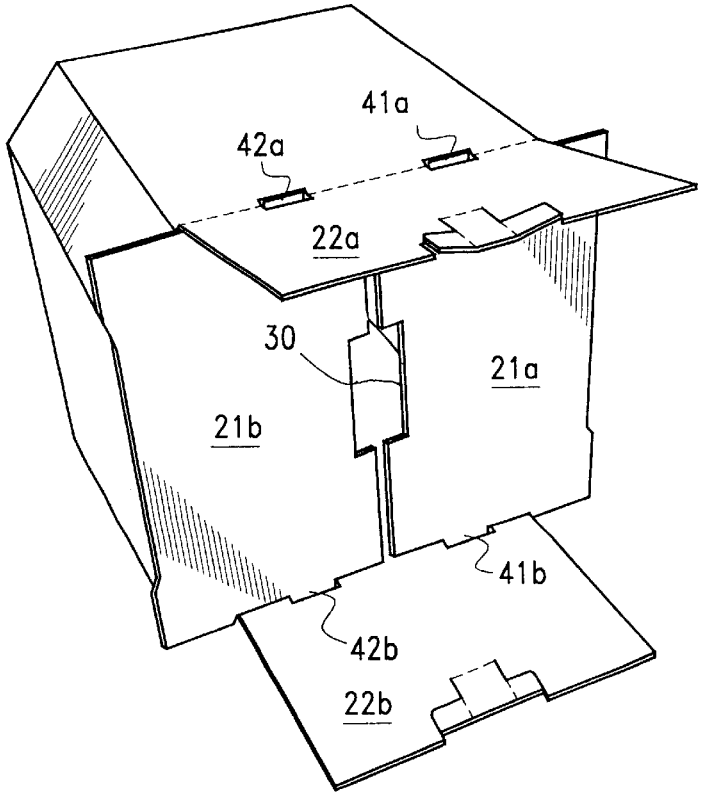
FIG. 6 is a bottom perspective view similar to FIG. 5, but showing both major flaps folded inwardly and their associated alignment tabs engaged in respective slots to hold the box in the position shown.

The bottom of the box is closed by opposed pairs of major bottom flaps 21*a*, 21*b* and minor bottom flaps 22*a*, 22*b*, respectively foldably joined along fold lines 23*a*, 23*b* and 24*a*, 24*b* at one edge to the bottom edges of the opposed pairs of side walls. The major and minor bottom flaps have opposite free edges 25*a*, 25*b* and 26*a*, 26*b*, respectively, with notches 27*a*, 27*b* in the free edges of the respective major flaps, and T-shaped locking tabs 29*a*, 29*b* in the free edges of the respective minor flaps. When the major flaps are folded inwardly over the bottom of the box, as seen in FIG. 6, the notches define a central opening 30 through the adjacent free edges of the major flaps. The locking tabs are foldably joined at one end to their respective bottom panels along score lines 31 and 32, respectively, and have oppositely outwardly directed arms 33*a*, 33*b* and 34*a*, 34*b*, respectively, on their free ends.

The major flaps include side portions 35*a*, 35*b* and 36*a*, 36*b*, respectively, extending in alignment with and cut from the bottom ends of the associated diagonal corner panels, so that when the major flaps are folded inwardly over the bottom of the box, the corners of the side portions project beyond the diagonal corner panels to define fastening tabs 37, 38, 39 and 40 that may be used to secure the box to a pallet. In this regard, the box may be placed upon a suitable pallet, and the tabs stapled or otherwise secured to the pallet.

Figure 5:
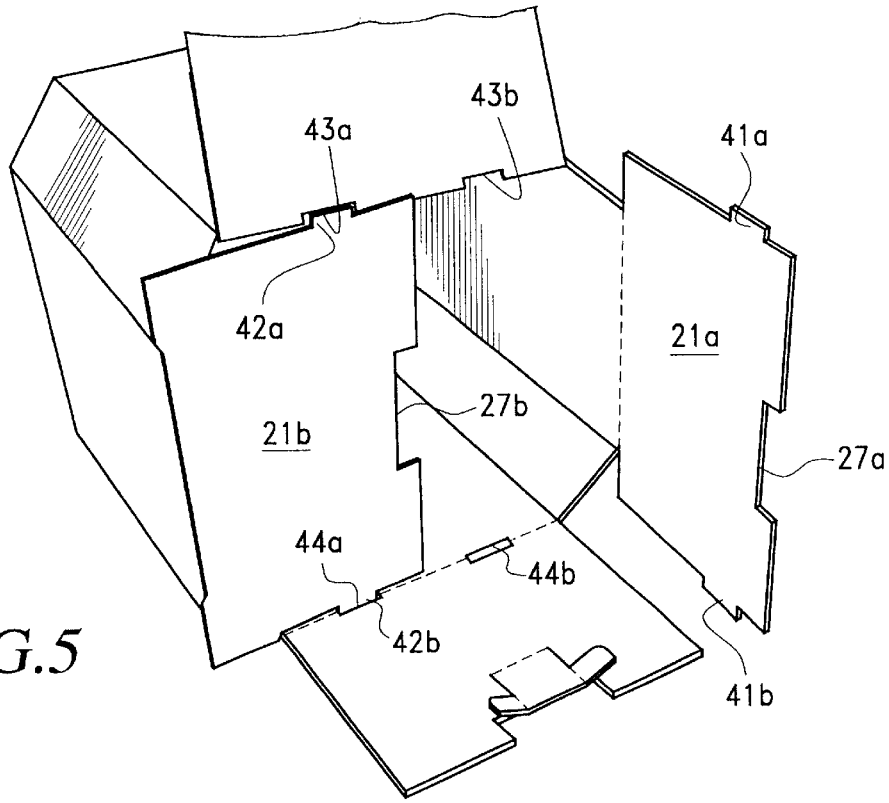
FIG. 5 is a bottom perspective view of the box, shown with one of the major flaps folded inwardly to bring its associated alignment tab into registry with an associated slot at the score of the adjacent minor flap.

Small tabs 41*a*, 41*b* and 42*a*, 42*b*, project from the outer edges of the respective side portions, and in a preferred construction are positioned near the free edge of the respective flaps. Pairs of spaced slots 43*a*, 43*b* and 44*a*, 44*b* are formed along the respective scores for the minor bottom flaps, and when the major bottom flaps are folded inwardly, as shown in FIGS. 5 and 6, the tabs 41*a*, 41*b* and 42*a*, 42*b* sweep along the surface of the minor bottom flaps until they come into registry with the slots, whereupon the tabs project through the slots. The tabs and slots are located so that when they are interengaged the box is properly squared up, and is held in this position. As seen in the drawings, the slots do not extend into the side walls, whereby the crush strength of the box is preserved. Moreover, the tabs extend into the slots but do not project substantially therethrough, whereby they are substantially flush with the outer surface of the sidewall. When the major and minor flaps are folded inwardly over the bottom of the box into overlying relationship with one another, it is necessary only to press inwardly on the looking tabs, as depicted in FIGS. 8–11, to cause the tabs to flex about their respective score lines and project through the opening 30. The arms 33*a*, 33*b* and 34*a*, 34*b* flex during this insertion, and after passing through the opening spring outwardly to lock behind the bottom flaps.

Figure 1:
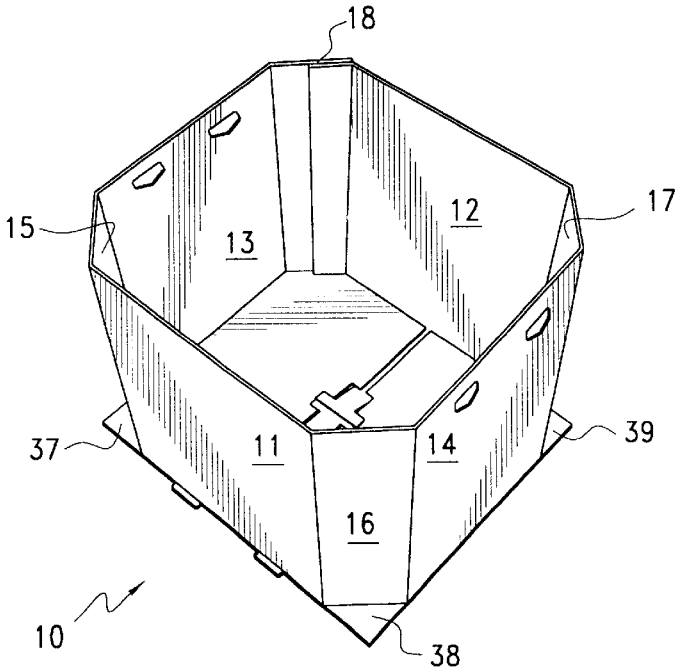
FIG. 1 is a top perspective view of an erected box according to the invention, shown without a cover or cap.
Figure 2:
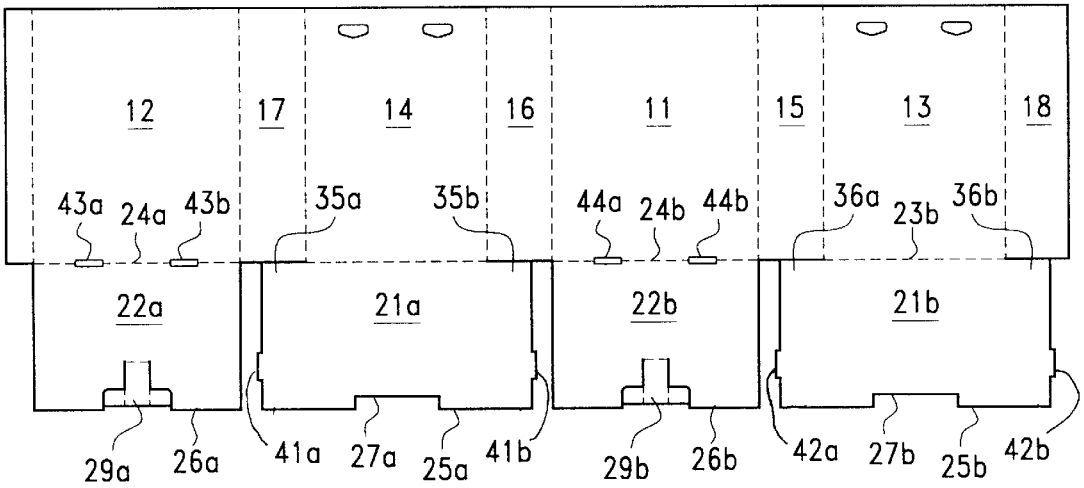
FIG. 2 is a top plan view of the blank used to make the box of the invention.

The box of the invention is made from a single blank 50 of material (see FIG. 2), and includes a glue flap 51 on one side edge thereof. During manufacture, the blank is folded upon itself and the glue flap is adhesively attached to a corner panel 18 at the opposite edge of the blank to form a flattened, openended tubular construction as shown in FIG. 3. The box may be stored and shipped in this flattened condition to a paint of use.

At the point of use, the flattened box is opened up or expanded into the tubular configuration shown in FIG. 4. The box is easiest to set up while lying on its side, with the minor bottom flaps 22*a* and 22*b* oriented uppermost and lowermost, respectively, as depicted in FIGS. 4–11. One of the major bottom flaps 21*a* is then folded inwardly over the open end of the box, sweeping the tabs 41*a* and 41*b* over the facing surfaces of flaps 22*a* and 22*b* until the tabs come into registry with the slots 43*a* and 44*a* at the respective scores for flaps 22*a* and 22*b*, whereupon the tabs project through the slots to square up the box and hold it in this squared position. This is depicted in FIG. 5, where the top flap 22*a* is shown in a raised position for purpose of clarity, but this flap could be held in a generally horizontal position similar to the opposite flap 22*b*, The opposite major bottom flap 21*b* is then also folded inwardly, as shown in FIG. 6, bringing its tabs 42*a* and 42*b* into registry with the slots 43*b* and 44*b*, respectively, locking the major bottom flaps in their inwardly folded position and holding the box in properly squared relationship.

Figure 7:
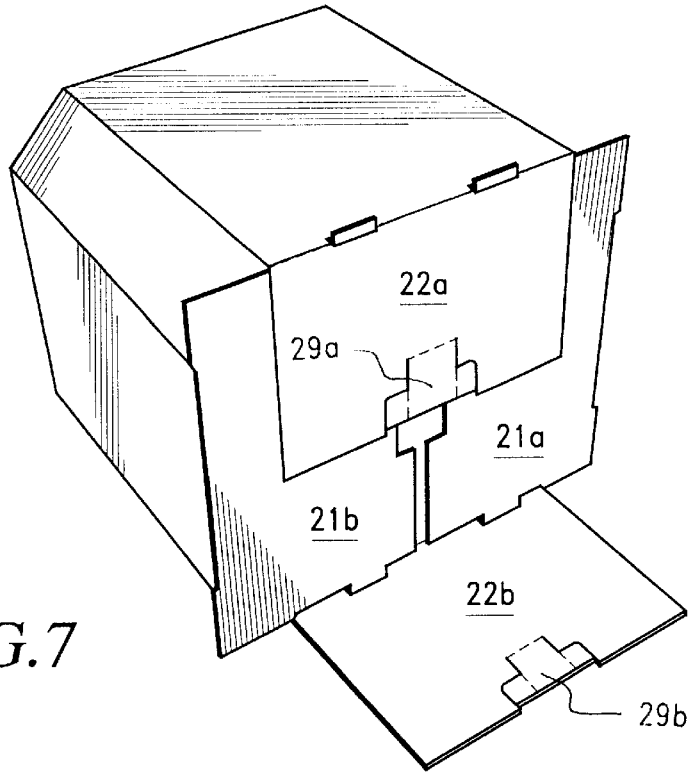
FIG. 7 is a bottom perspective view similar to FIG. 6, but showing one of the minor bottom flaps folded about its score line into overlying relationship with the major bottom flaps, and with the locking tab in position to be inserted through the opening formed by the notches in the minor flaps.
Figure 8:
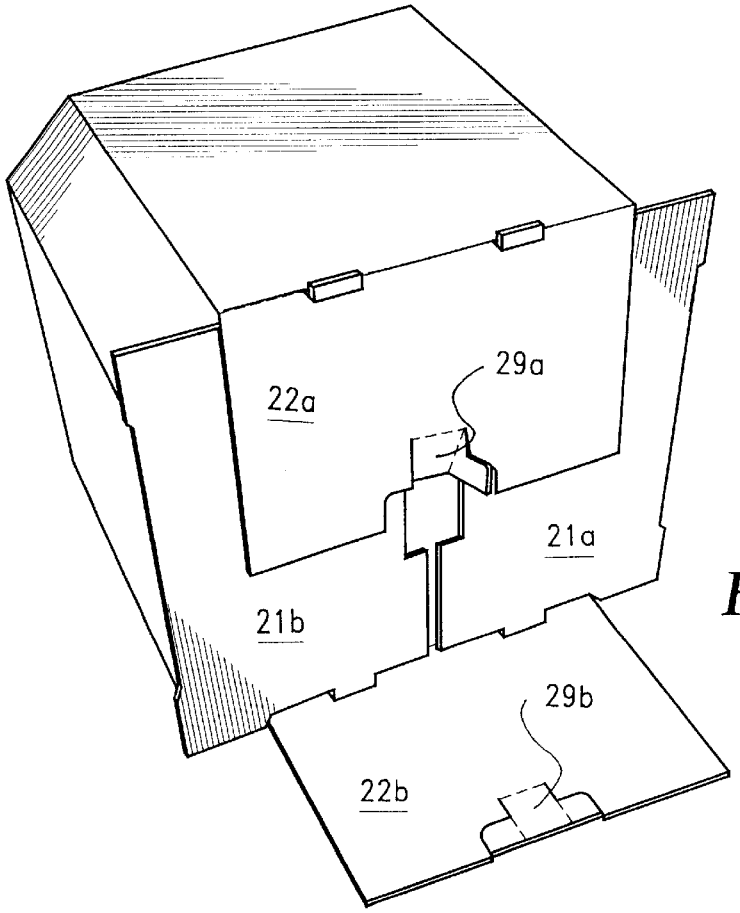
FIG. 8 is a bottom perspective view similar to FIG. 7, but showing the locking tab partially inserted through the opening.
Figure 9:
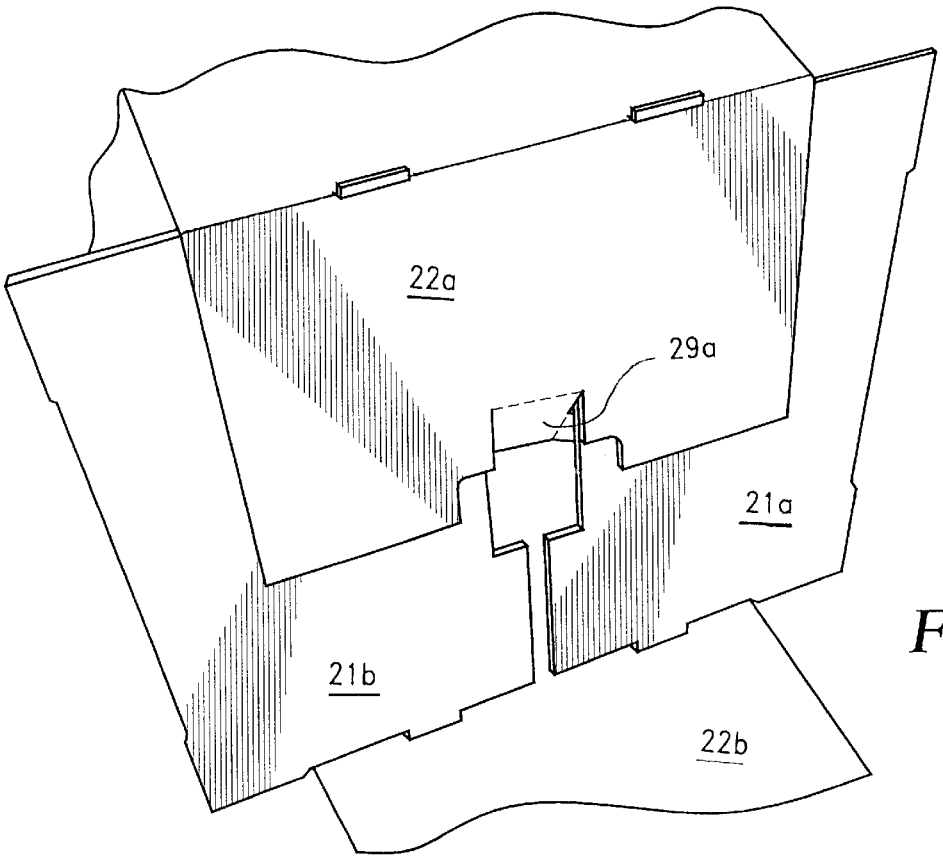
FIG. 9 is a bottom perspective view similar to FIG. 8, but showing the locking tab fully inserted through the opening.
Figure 10:
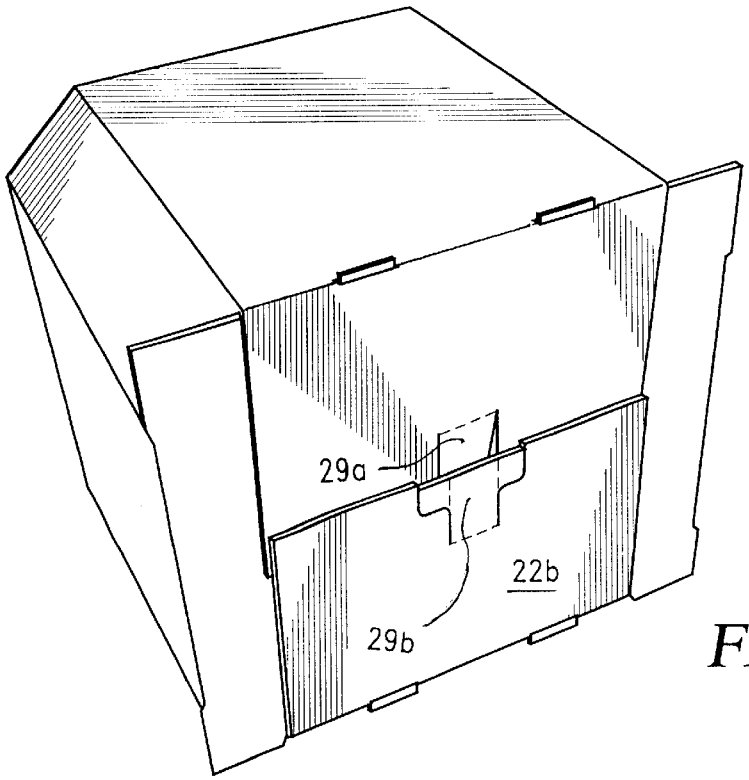
FIG. 10 is a bottom perspective view similar to FIG. 9, but showing the other minor bottom flap folded upwardly into overlying relationship with the major bottom flaps, and the locking tab in that flap positioned in alignment with the opening formed in the minor flaps.
Figure 13:
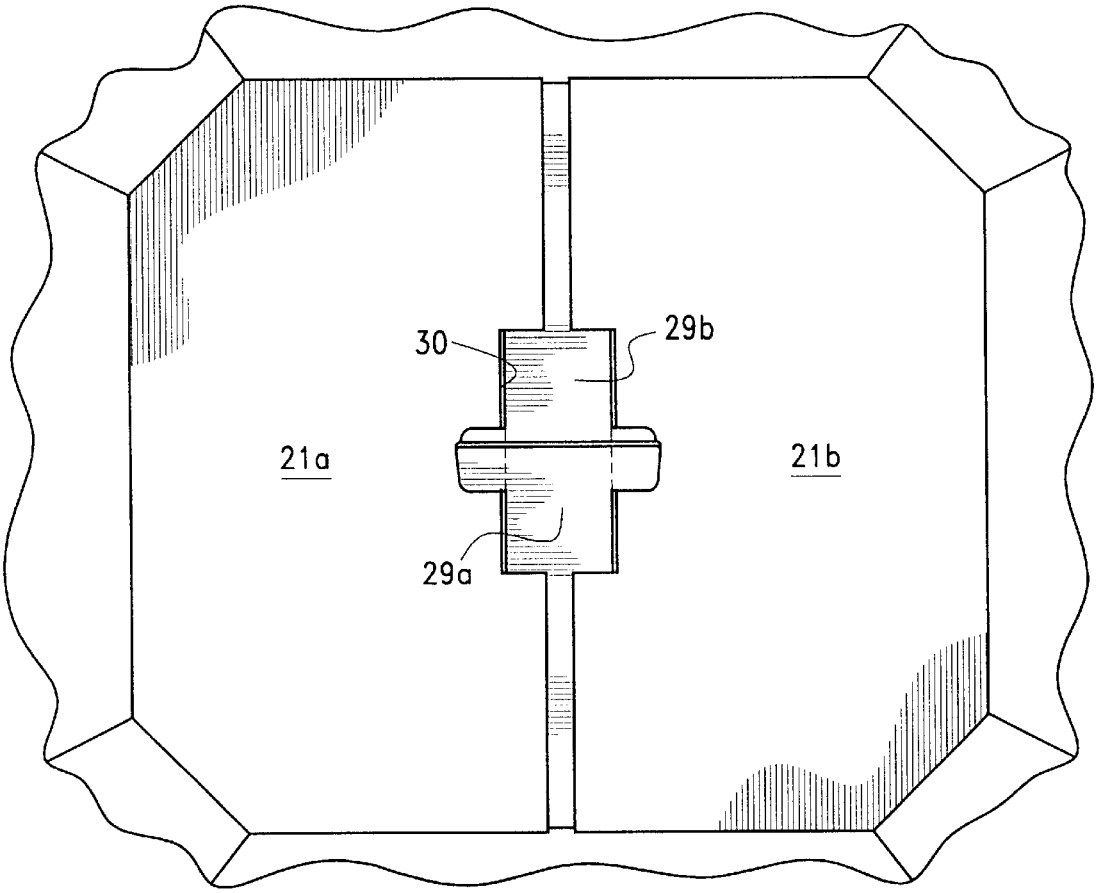
FIG. 13 is an inside top plan view of the box of the invention.

One of the minor bottom flaps 22*a* is folded downwardly over the inwardly folded major flaps, as shown in FIG. 7, and the locking tab 29*a* on that flap is pressed inwardly to insert it through the opening 30, locking that flap in its inwardly folded relationship over the bottom of the box. Although either minor flap could be folded inwardly first, the uppermost flap is shown folded inwardly first in FIGS. 7–11.

The opposite minor bottom flap 22*b* is then folded inwardly and its locking tab 29*b* is inserted through the opening 30 to lock that flap in position. The box is now erected and can be stood up on Its bottom ready for use.

At least some bulk boxes in accordance with the invention may have a liner laminated on the inside wall. The liner, and the box, may both comprise triple wall AA flute, suitably treated for moisture resistance. Alternatively, other flute constructions, suitable for a particular application, may be used in the construction of the box, Further, in the particular embodiment illustrated and described herein, openings 60 are formed in some of the sidewalls for cooperating with a locking structure on a cap (not shown) to be placed on the open upper end of the box.

While particular embodiments of the invention have been illustrated and described in detail herein, it should be understood that various changes and modifications may be made to the invention without departing from the spirit and intent of the invention as defined by the scope of the appended claims.

What is claimed is:

1. A bulk box having a top and a bottom comprising:

opposed pairs of parallel side walls defining an enclosure;

opposed pairs of bottom flaps foldably joined along score lines at one edge to respective pairs of said opposed side walls, said bottom flaps having free edges opposite their connection with the respective side walls, said flaps having a width such that their free edges lie substantially at a midportion of the box bottom when the flaps are folded into a closed position over the bottom, outwardly projecting aligning tabs on opposite side edges of at least one of said bottom flaps; and at least one slot at the score line joining each of a pair of said bottom flaps adjacent said at least one bottom flap, said aligning tabs and slots being located so that as said at least one bottom flap is folded inwardly over the bottom, the tabs sweep along surfaces of said adjacent bottom flaps and move into registry with the slots and extend into the slots to align and square up the box and hold it in this squared-up position, said slots being located so that they do not extend into the side walls.

2. A bulk box as claimed in claim 1, wherein:

said aligning tabs include aligning tabs on the opposite side edges of each of the bottom flaps in a first opposed pair of said bottom flaps; and said slots include a pair of spaced slots at the score joining each of the bottom flaps in a second opposed pair of said bottom, one of the slots in each pair of slots being positioned to receive the tabs at opposite sides of one of the flaps in the first pair of flaps.

3. A bulk box as claimed in claim 1, wherein:

diagonal corner panels extend between the opposed pairs of side walls; and the pairs of bottom flaps include a pair of opposed major flaps having side portions extending in alignment with and cut from the bottom ends of the associated diagonal corner panels, so that when the major flaps are folded inwardly over the bottom of the box, corners of the side portions project beyond the diagonal corner panels to define fastening tabs that may be used to secure the box to a pallet.

4. A bulk box as claimed in claim 3, wherein:

the aligning tabs are on the outer edges of the side portions of the major bottom flaps; and the slots are at the scores joining the minor bottom flaps to their associated side panels.

5. A bulk box as claimed in claim 4, wherein:

the box is made of corrugated paperboard.

6. A bulk box as claimed in claim 1, wherein:

the free edges of the bottom flaps in another of said pair of opposed bottom flaps have a notch therein, said notches forming a central opening in the box bottom when the flaps are folded inwardly over the bottom of the box; and the free edges of another pair of opposed bottom flaps have a T-shaped locking tab formed therein, said locking tabs joined to their respective flaps by a score line at one end and each having outwardly projecting arms at their other end, said locking tabs being adapted to be folded about their score lines and inserted through the opening to lock the flaps in their inwardly folded position over the box bottom.

7. A bulk box as claimed in claim 2, wherein:

diagonal corner panels extend between the opposed pairs of side walls; and the pairs of bottom flaps include a pair of opposed major flaps having side portion extending in alignment with and cut from the bottom ends of the associated diagonal corner panels, so that when the major flaps are folded inwardly over the bottom of the box, corners of the side portions project beyond the diagonal corner panels to define fastening tabs that may be used to secure the box to a pallet.

8. A bulk box as claimed in claim 7, wherein:

the aligning tabs are on the outer edges of the side portions of the major bottom flaps; and the slots are at the scores joining the minor bottom flaps to their associated side panels.

9. A bulk box as claimed in claim 8, wherein:

the free edges of each of the bottom flaps have in one of said pair of opposed bottom flaps a notch therein, said notches forming a central opening in the box bottom when the flaps of said pair are folded inwardly over the bottom of the box; and the free edges of each of the bottom flaps in another of said pair of opposed bottom flaps have a T-shaped locking tab formed therein, said lock tabs joined to their respective flaps by a score line at one end and each having outwardly projecting arms at their other end, said locking tabs being adapted to be folded about their score lines and inserted through the opening to lock the flaps in their inwardly folded position over the box bottom.

10. A corrugated paperboard octagonal bulk box, comprising:

opposed pairs of parallel side walls and interposed diagonal corner panels;

interlocking pairs of opposed major bottom flaps and opposed minor bottom flaps closing the bottom of the box, said flaps each joined along a score line at one edge thereof to respective side walls, and each said flap having an opposite free edge;

an outwardly projecting aligning tab on each of the opposite side edges of each major bottom flap; and a pair of spaced slots at the score connecting each minor bottom flap with its associated side wall, said tabs and slots located so that as said major bottom flaps are folded inwardly over the bottom of the box the aligning tabs move into registry with the slots and extend therethrough to square up the box and hold it in that position.

11. A bulk box as claimed in claim 10, wherein:

said minor bottom flaps are folded into overlying relationship with the major flaps; and interengaging lock means are on the free edges of the major and minor bottom flaps to lock the flaps in the folded closed position.

12. A single, unitary blank for forming a bulk box comprising:

at least four sidewall panels;

a bottom flap foldably connected to one end of each sidewall panel;

an aligning tab on each of the opposite side edges of at least one of said bottom flaps; and at least one aligning slot at the folding connection of each of two bottom flaps adjacent said at least one bottom flap, said aligning tabs and slots being positioned so that they interengage as the blank is being set up to from a box, and said slots being located so that they do not extend into the sidewall panels.

13. A folded-flat bilk box made from a single blank of material, comprising:

a plurality of sidewall-forming panels;

a plurality of bottom-forming flaps foldably connected to respective said sidewall panels;

an aligning tab on each of the opposite side edges of at least one of said bottom-forming flaps;

at least one aligning slot at the folding connection of each of two said bottom-forming flaps, said aligning tabs and slots being positioned so that they interengage as the bank is being set up to form a box and said slots being located so that they do not extend into the sidewall-forming panels; and a glue flap connected to one of said sidewall-forming panels at one end of the bank, said blank folded upon itself with said glue flap adhesively joined to a said sidewall-forming panel at an opposite end of the blank, with some of said sidewall-forming panels and some of said bottom-forming panels overlying other said sidewall-forming panels and other said bottom-forming panels, respectively, to form a compact flattened box for shipment to a point of use, where the box may be quickly and easily set up.

* * * * *